US005934484A

United States Patent [19]

Grimes

[11] Patent Number: 5,934,484

[45] Date of Patent: Aug. 10, 1999

[54] CHANNELING DAM FOR CENTRIFUGAL CLEANER

[75] Inventor: David B. Grimes, Greenfield, Mass.

[73] Assignee: Beloit Technologies, Inc., Wilmington, Del.

[21] Appl. No.: 08/844,040

[22] Filed: Apr. 18, 1997

[51] Int. Cl.[6] ..... B04C 3/04

[52] U.S. Cl. ..... 209/725; 209/731; 209/733; 210/512.1

[58] Field of Search ..... 209/208, 210, 209/725, 724, 727, 731, 733; 210/512.1, 512.2, 512.3

[56] References Cited

U.S. PATENT DOCUMENTS

| | | | |
|---|---|---|---|
| 2,102,525 | 12/1937 | Freeman . | |
| 2,787,374 | 4/1957 | Krebs | 209/211 |
| 2,809,567 | 10/1957 | Woodruff | 92/28 |
| 3,405,803 | 10/1968 | Bähr et al. | 209/211 |
| 4,259,180 | 3/1981 | Surakka et al. | 209/211 |
| 4,309,283 | 1/1982 | Vikiö et al. | 209/211 |
| 4,378,289 | 3/1983 | Hunter | 209/211 |
| 4,578,199 | 3/1986 | Peel et al. | 210/788 |
| 4,786,412 | 11/1988 | Lister et al. | 210/512.1 |
| 4,797,203 | 1/1989 | Macierewicz | 209/211 |
| 4,834,887 | 5/1989 | Broughton | 209/725 X |
| 4,842,145 | 6/1989 | Boadway | 209/144 |
| 4,919,796 | 4/1990 | Vikiö | 209/211 |
| 5,024,755 | 6/1991 | Livsey | 209/211 |
| 5,240,115 | 8/1993 | Crossley et al. | 209/211 |
| 5,266,198 | 11/1993 | Vikiö | 210/512.1 |
| 5,566,835 | 10/1996 | Grimes | 209/725 |
| 5,769,243 | 6/1998 | McCarthy | 210/512.2 X |

FOREIGN PATENT DOCUMENTS

| | | | |
|---|---|---|---|
| 058484 | 8/1982 | European Pat. Off. | 209/725 |
| 0 105037 | 4/1984 | European Pat. Off. . | |
| 3329256 | 2/1984 | Germany . | |

OTHER PUBLICATIONS

"*Uniflow Cleaners*," by Beloit Corporation, 4 pages, Form No. SB–79–004R 7114.

"*Beloit Jones Posiflow™ Cleaners*," by Beloit Corporation, 2 pages, Form No. SB–79–005.

*Primary Examiner*—Tuan N. Nguyen

*Attorney, Agent, or Firm*—Lathrop & Clark LLp

[57] ABSTRACT

The centrifugal cleaner of this invention is of the type having an inverted cylindrical cone, with a tangential inlet at the top and an outlet at the bottom. The improvement consists of placing a ring or flow smoothing means on the inside surface of the cylindrical cone about one-half the diameter of the base of the cone down from the inlet. The ring forces the stock injected into the centrifugal cleaner to flow towards the axis of the cone away from the inside cone wall. Once the stock passes over the dam it once again flows to the inner wall of the cone. The stock, in being forced to flow over the ring, is made uniform, eliminating spiraling of the flow which has been found to decrease the efficiency with which separation within the cleaner is accomplished.

17 Claims, 1 Drawing Sheet

CHANNELING DAM FOR CENTRIFUGAL CLEANER

FIELD OF THE INVENTION

The present invention relates to particle separators in general, and to hydrocyclone cleaners for paper pulp in particular.

BACKGROUND OF THE INVENTION

Paper is manufactured from cellulose fibers which may be extracted from wood or may be recovered recycled paper. The various sources and processes for creating and separating the individual wood fibers results in a paper stock containing contaminants which must be removed before the wood fibers can be used to make paper. While many contaminants can be removed from the fiber stock by washing, other contaminants are of a size or physical makeup which makes their removal by filtration difficult. Historically, hydrocyclones or centrifugal cleaners of relatively small size, normally from 2–72 inches in diameter, have been employed. It has been found that the centrifugal type cleaner is particularly effective at removing small size contaminants such as broken fibers, spherical particles, and seeds, as well as non-woody fine dirt such as bark, sand, grinderstone grit and metal particles.

The relatively small size of the centrifugal cleaners allows the employment of certain hydrodynamic and fluid dynamic forces provided by the combination of centrifugal forces and liquid shear planes produced within the hydrocyclone which allows the effective separation of small contaminants and debris.

The advent of certain modern sources of pulp fibers such as tropical wood species and recycled paper which is contaminated with stickies, waxes, hot melt glues, polystyrenes, polyethylenes, and other low density materials including plastics and shives presents additional problems in the area of stock preparation. The ability of the hydrocyclone to separate both high density and low density contaminants gives them particular advantages in dealing with the problem of cleaning modern sources of paper fiber. Many modern fiber sources tend to be contaminated with both heavyweight and lightweight contaminants.

In one common type of forward cleaner, the flow of acceptable material must change direction at the bottom of the cleaner and travel back up to the top. With such a cleaner in is difficult to effect changes in reject flow volume. To limit the amount of good fiber lost, it is necessary to restrict the volume of material rejected. This usually requires that the rejects orifice be small and in the center of the cleaner. Small orifices, however, are subject to clogging.

In my earlier U.S. Pat. No. 5,566,835 which is incorporated herein by reference, a hydrocyclone is described which can separate pulp stock into a heavyweight reject stream, a lightweight reject stream, and an accepts stream containing the useful wood fibers.

Through flows such as disclosed in the above referenced patent can develop a channeling of the injected flow which causes the injected flow to spiral down the inside surface of the cone forming the body of the hydrocyclone. This channeling limits the efficiency of the separation process.

While existing hydrocyclones have been developed to remove both heavy and light contaminants, further improvements in this area are highly desirable. The hydrocyclone as it is used to clean pulp is a small device, and is used in banks of up to sixty or more cleaners. Thus each hydrocyclone must be of extremely high reliability and require minimal maintenance or the entire hydrocyclone system will have poor reliability and high maintenance costs. Of particular relevance is the efficiency with which the hydrocyclone performs the separation function. Efficiency determines the number of stages which must be used to achieve a given level of separation. More separation stages means higher energy consumption and higher equipment costs.

What is needed is a through flow cleaner which is not subject to channeling thus providing increased effectiveness in separating desirable fiber from undesirable lightweight, and heavyweight components of a flow of pulp fiber stock.

SUMMARY OF THE INVENTION

The centrifugal cleaner of this invention is of the type having a tangential inlet at the top of an inverted cylindrical cone, and a primary outlet positioned near the apex or bottom of the inverted cone. This type of cleaner is sometimes referred to as a through flow cleaner. Water containing papermaking fibers and contaminants of various types is injected for cleaning into the centrifugal cleaner for separation of fiber from lightweight and heavyweight contaminants by the centrifugal and hydrodynamic forces created within the centrifugal cleaner. The injected stock spirals against the inner surface of the cylindrical cone as it moves towards the bottom of the cleaner.

The improvement of this invention comprise placing a ring or dam on the inside surface of the cylindrical cone about one-half the diameter of the base of the cone down from the inlet. The dam forces the stock injected into the centrifugal cleaner to flow towards the axis of the cone away from the inside cone wall. Once the stock passes over the dam it once again flows to the inner wall of the cone. However by being forced to flow over the dam the flow of stock is made uniform, eliminating spiraling of the flow which has been found to decrease the efficiency with which separation of the lightweight and heavyweight particles is accomplished.

It is an object of the present invention to provide a centrifugal cleaner which achieves higher separation efficiency.

It is another object of the present invention to provide a centrifugal cleaner which can separate lightweight, and heavyweight contaminants from stock containing paper fiber.

It is a further object of the present invention to provide a cleaner with a hydraulic diffuser which provides an even flow of fluid through the operational portion of a hydraulic cleaner.

Further objects, features and advantages of the invention will be apparent from the following detailed description when taken in conjunction with the accompanying drawings.

DESCRIPTION OF THE PREFERRED EMBODIMENT

Figure 1:
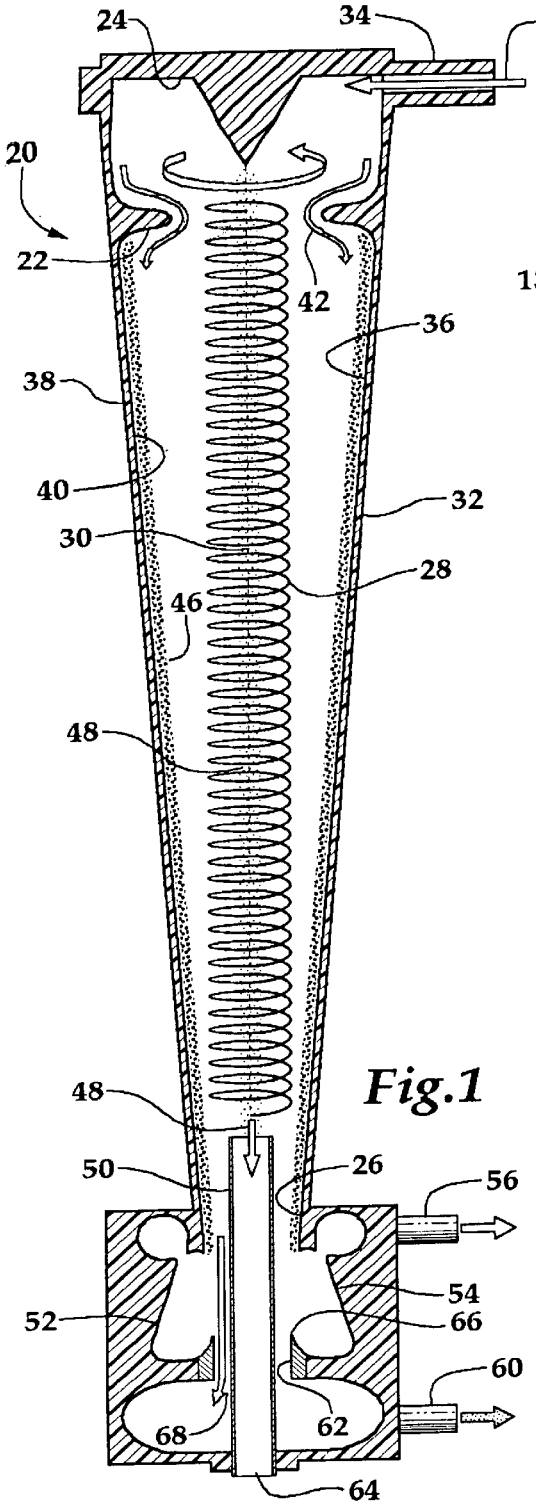
FIG. 1 is schematic cross-sectional view of an improved centrifugal cleaner of the present invention.
Figure 2:
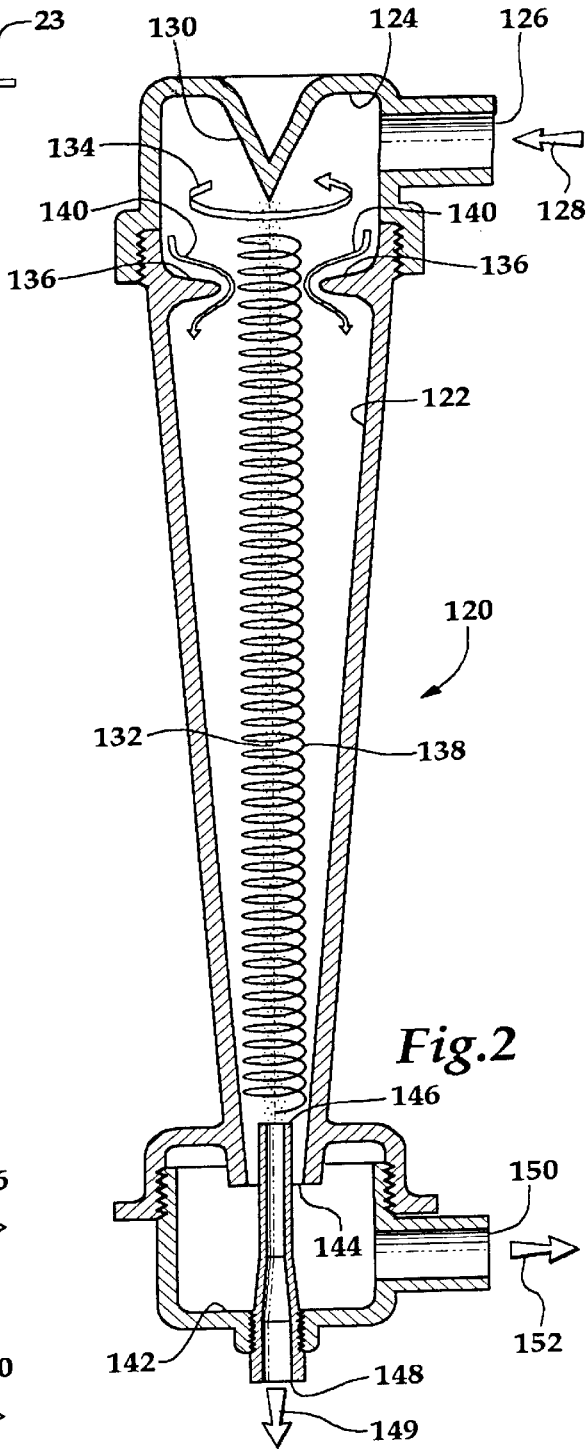
FIG. 2 is a schematic cross-sectional view of an alternative embodiment centrifugal cleaner employing the hydraulic diffuser shown in FIG. 1.

Referring more particularly to FIGS. 1–2 wherein like numbers refer to similar parts a centrifugal cleaner 20 is shown in FIG. 1. There are three basic types of hydrocyclone cleaners. One is a so-called forward cleaner where lightweight accepts are removed from the middle of the cyclone, at the top of an inverted cone, and heavyweight rejects are removed from the bottom or apex of the cone. When it became desirable to remove lightweight materials a so-called reverse cleaner was developed. The reverse cleaner removed a small amount of reject flow from the top while the majority of the fluid or accepts flow passed down through the cyclone to exit from the bottom. This was not very efficient because the light reject flow had to flow upwardly in a direction opposite to that of the accepts flow. A third cleaner type, available from Beloit Corporation of Beloit, Wis., is the Uniflow cleaner which is similar to the cleaner 120 shown in FIG. 2, but without the ring 136, which removes the lightweight reject flow through a standpipe at the bottom of the hydrocyclone cone. The accept flow is collected from around the standpipe by a chamber 142.

My earlier U.S. Pat. No. 5,566,835 is an improvement on the Uniflow cleaner. The cleaner of this invention adds the ring 22 to my prior device, and is shown in FIG. 1. Thus the centrifugal cleaner 20 is a device where lightweight rejects, heavyweight rejects, and accepts are all produced by a single hydrocyclone 20. The ring improves the operation of the cleaner by eliminating a tendency of the inlet stock to spiral down the inside walls 40 of the inverted conical chamber 36 of the cleaner 20. The ring 22 could also be any hydraulic device which equalizes the flow of stock through the hydrocyclone, and may be effective with any hydrocyclone with a strong or dominant flow from base to 24 to the apex 26.

The hydrocyclone 20 has a cylindrical column of water 28 from the top/base 24 to bottom/apex 26 which is rotating uniformly at a selected radius and rotating more rapidly towards the center or axis 30 of the hydrocyclone 20. The flow through a hydrocyclone is quasi-laminar, meaning it acts like laminar flow but the Reynolds No. is too high for true laminar flow. The advantage and the disadvantage of quasi-laminar flow is that once established the flow is extremely stable and the various components of the stock can be separated. However the quasi-laminar flow also propagates initial unevenness in the injected flow--thus the need for the hydraulic dam or ring 22.

The centrifugal cleaner 20 receives input stock into the inverted conical chamber 36, which acts as a hydrocyclone to displace higher density components of the stock to the inside walls 40 of the chamber 36, while lightweight components remain in the center 30 of the chamber 36, with acceptable fiber in the in-between region.

The cleaner 20 has a body 33 which has a fluid inlet 34 through which fluid or stock to be cleaned is injected. Portions of the body 33 define the first chamber 36 which has outer inverted conical walls 38 and inner inverted conical walls 40. The input stock is injected tangentially into the first chamber. The input fluid is caused to be distributed within the inverted conical chamber. The ring 22 forces the flow, shown by arrows 42, inwardly toward the axis 30 of the first chamber 36. The hydraulic dam formed by the ring 22 prevents the stock 23 entering from the inlet 34 from developing a flow spiral which propagates down the inside conical walls 40. The smooth quasi-laminar flow together with the centrifugal and hydrodynamic forces generated within cause the heavyweight reject particles to move to a position in closer proximity to the walls. The lightweight reject particles are driven to a position along the axis 30 of the chamber and the acceptable particles are positioned primarily between the heavyweight reject particles 46 and the lightweight reject particles 48.

A tube 50 extends axially within the body 32 to receive a portion of the flow containing lightweight reject particles 48. The tube 50 is referred to as a vortex finder because of its locations at the center of the rotating column 28 where the lightweight particles 48 collect. The tube 50 collects the lightweight reject particles 48 and discharges them through the lightweight reject outlet 64.

Portions of the body 32 define a second chamber 52 positioned beneath the first chamber 36 and having generally frustoconical walls 54. The diameter of the second chamber 52 narrows as it extends upwardly. Portions of the body also define a heavyweight reject outlet 56 which extends outwardly from the walls 54 of the second chamber 52.

Yet other portions of the body define an acceptable particle flow outlet 60 positioned below the second chamber 52 and in communication therewith.

A first splitter 62 is fixed to the body 32 and extends into the second chamber 52 above the acceptable particle flow outlet 60. The splitter 62 has a lip 66 which extends into the flow from the first chamber 36, the lip 66 serves to split a portion of the flow containing heavyweight reject particles into the second chamber 52, while allowing the remainder of the flow containing acceptable particles to flow to the acceptable particle flow outlet 60. A recirculating flow is established within the second chamber 52 of a portion of the flow containing heavyweight reject particles. The recirculating flow extends adjacent the flow downward from the first chamber, the downward flow being indicated by arrows 68. This recirculation flow produces low turbulence so the downward flow of accepts indicated by arrows 68 is not disturbed.

The hydraulic dam or ring 22 improves the performance of the cleaner 20 by preventing the inherent non-uniformity of the injected flow indicated by arrow 23 from introducing non-uniformity of the flow into the second chamber.

The cleaner 20 preserves the advantages disclosed in my earlier Patent of providing a geometry which avoids narrow passages through which heavyweight reject flow must pass, and also maintains sufficient flow velocity that the opportunity for clogging or blockage is greatly reduced.

The ring 22 has a cross-section in the shape of a normal distribution curve which is designed to minimize hydraulic losses when turbulence is produced by irregularities in the flow path of the stock as it moves through the cleaner 20. For a centrifugal cleaner 20 with a base diameter of three inches and a ring space about one and one-half inches below the inlet 34 the ring will preferably extend 0.56 inches from the wall 40 toward the axis 30.

An alternative cleaner 120 of this invention is shown in FIG. 2. The cleaner has an inverted conical chamber 122 which acts as a hydrocyclone. The chamber 122 has a base 124 typically about three inches in diameter. An inlet 126 injects stock shown by arrow 128 tangentially at the base 124. A central cone 130 extends from the base along the axis 132 of the chamber 122. The central cone 130 aides in establishing a rotating flow indicated by arrow 134. A hydraulic dam formed by a ring 136 is positioned a distance approximately one-half the base diameter beneath the inlet 126. The ring 136 performs a function similar to the hydraulic dam or ring 22 shown in FIG. 1. The shape of the conical chamber 122 together with the tangential flow injection creates a rotating cylinder of stock indicated by arrows 138. The ring 136 prevents any spiral of stock from the inlet propagating into the rotating cylinder within the chamber 122. By forcing the stock to flow radially inward towards the axis 132 as shown by arrows 140 the downward flow through the cleaner 120 is prevented from propagating any non-uniformity created by the inlet conditions. A secondary chamber 142 is positioned at the apex and outlet 144 of the conical chamber 122. The secondary chamber supports a tube 146, known as a vortex finder, through which light-weight rejects, indicated by arrow 149, are removed through an outlet 148. Accepts are removed through an accepts outlet 150 as indicated by arrow 152.

In a forward cleaner where the stock enters at the base of a hydrocyclone and the accepts are removed through a tube extending from the center line of the base, the pressure drop within the cleaner is mainly between the inlet and the accepts outlet which is substantially radial with respect to the axis of the hydrocyclone. The pressure drop within a through flow cleaner such as those disclosed in FIGS. 1 and 2 is between the stock inlet at the base of the cleaner and the outlet for rejects and accepts at the bottom or apex of the cleaner. Thus with a through flow cleaner the hydraulic gradient or pressure drop lies substantially along the axis of the hydrocyclone. Where the pressure drop extends along the axis it has the ability to propagate a spiral pattern induced by the stock inlet. In existing through flow cleaners a wear pattern can often be seen where a spiral of stock is formed on the inside of the hydrocyclone. This undesirable spiral can be eliminated by a hydraulic dam as described herein.

It should be understood that the ring 22 functions as a hydraulic dam and a means for smoothing the hydraulic flow of the stock through the centrifugal cleaners 20, 120. Other structures which can perform the required function include an array of gears or comb-like teeth projecting from the inner inverted conical walls of the first chamber. Additionally, projection which could be used are small hydrodynamic vanes. In all cases the structure will be designed for minimum turbulence and flow obstruction while regularizing the inlet flow to prevent spiraling within the cleaner 20. Any of the foregoing structures which serve to create a hydraulic dam which smooths the injected hydraulic stock so that its motion through the first chamber is uniform.

It should be understood that centrifugal cleaners can be constructed of various sizes preferably with a base of about three inches but within a range of base diameters from one inch to over thirty-six inches.

Centrifugal cleaners 20, 120 are typically employed with stock having a consistency of less then 0.1 to about five percent dry weight fiber.

It is understood that the invention is not limited to the particular construction and arrangement of parts herein illustrated and described, but embraces such modified forms thereof as come within the scope of the following claims.

I claim:

1. A centrifugal cleaner for paper pulp comprising:

a first conical chamber which acts as a hydrocyclone, the chamber having a base defining a first diameter and a conical wall defining a conical axis, the conical wall tapering inwardly and towards an outlet opposite the base;

an inlet opening into the chamber and tangent to the conical wall so as to cause injected fluid to rotate within the chamber; and a ring mounted within the first chamber to the conical wall beneath the inlet and between the inlet and the outlet, the ring extending from the wall towards the axis; and wherein there are no outlets from the cleaner except the outlet opposite the base.

2. The centrifugal cleaner of claim 1 wherein the ring is spaced about one-half the first diameter below the inlet opening.

3. The centrifugal cleaner of claim 1 wherein the ring has a smooth hydrodynamic shape similar to a normal distribution curve in cross-section.

4. The centrifugal cleaner of claim 1 wherein the base is positioned above the outlet and the chamber axis is aligned with the vertical.

5. A centrifugal cleaner for paper pulp comprising:

a first conical chamber which acts as a hydrocyclone, the chamber having a base defining a first diameter and a conical wall defining a conical axis, the conical wall tapering inwardly and towards an outlet opposite the base;

an inlet opening into the chamber and tangent to the conical wall so as to cause injected fluid to rotate within the chamber; and a ring mounted within the first chamber to the conical wall beneath the inlet and between the inlet and the outlet, the ring extending from the wall towards the axis; further comprising an inverted cone which extends axially along said chamber conical axis into the chamber past the inlet.

6. A centrifugal cleaner for paper pulp comprising:

a first conical chamber which acts as a hydrocyclone, the chamber having a base defining a first diameter and a conical wall defining a conical axis, the conical wall tapering inwardly and towards an outlet opposite the base;

an inlet opening into the chamber and tangent to the conical wall so as to cause injected fluid to rotate within the chamber; and a ring mounted within the first chamber to the conical wall beneath the inlet and between the inlet and the outlet, the ring extending from the wall towards the axis; further comprising a second chamber connected to the outlet of the conical chamber, the second chamber having an outlet for accepts flow, and a vortex finder extending into the outlet of the conical chamber, the vortex finder having an outlet for flow containing lightweight reject particles.

7. A centrifugal cleaner for paper pulp comprising:

an inverted conical chamber which acts as a hydrocyclone, the chamber having a base defining a first diameter and a conical wall defining a conical axis. the conical wall tapering inwardly and towards an outlet opposite the base;

an inlet opening into the chamber and tangent to the conical wall so as to cause injected fluid to rotate within the chamber; and a means for smoothing hydraulic flow mounted to the conical wall beneath the inlet and between the inlet and the outlet, the means extending from the wall towards the axis; wherein there are no outlets from the cleaner except the outlet opposite the base.

8. The centrifugal cleaner of claim 7 wherein the means for smoothing hydraulic flow is spaced about one-half the first diameter below the inlet opening.

9. A centrifugal cleaner for paper pulp comprising:

an inverted conical chamber which acts as a hydrocyclone, the chamber having a base defining a first diameter and a conical wall defining a conical axis, the conical wall tapering inwardly and towards an outlet opposite the base;

an inlet opening into the chamber and tangent to the conical wall so as to cause injected fluid to rotate within the chamber; and a means for smoothing hydraulic flow mounted to the conical wall beneath the inlet and between the inlet and the outlet, the means extending from the wall towards the axis; further comprising a second chamber connected to the outlet of the conical chamber, the second chamber having an outlet for accepts flow, and a vortex finder extending into the outlet of the conical chamber, the vortex finder having an outlet for flow containing lightweight reject particles.

10. A centrifugal cleaner for paper pulp comprising:

an inverted conical chamber which acts as a hydrocyclone, the chamber having a base defining a diameter and a conical wall defining a conical axis, the conical wall tapering inwardly and towards an outlet opposite the base;

an inlet opening into the chamber and tangent to the conical wall so as to cause injected fluid to rotate within the chamber; and a hydraulic dam mounted to the conical wall beneath the inlet and between the inlet and the outlet, the hydraulic dam extending from the wall towards the axis; wherein there are no outlets from the cleaner except the outlet opposite the base.

11. The centrifugal cleaner of claim 10 wherein the hydraulic dam is spaced about one-half the defined diameter below the inlet opening.

12. A centrifugal cleaner for paper pulp comprising:

an inverted conical chamber which acts as a hydrocyclone, the chamber having a base defining a diameter and a conical wall defining a conical axis, the conical wall tapering inwardly and towards an outlet opposite the base;

an inlet opening into the chamber and tangent to the conical wall so as to cause injected fluid to rotate within the chamber; and a hydraulic dam mounted to the conical wall beneath the inlet and between the inlet and the outlet, the hydraulic dam extending from the wall towards the axis; and further comprising a cone projected from the base and having an axis coincidentally with the axis of the chamber and extending into the chamber pass the inlet.

13. The centrifugal cleaner of claim 12 wherein the base is positioned above the outlet and the axis is aligned with the-vertical.

14. A centrifugal cleaner for paper pulp comprising:

an inverted conical chamber which acts as a hydrocyclone, the chamber having a base defining a diameter and a conical wall defining a conical axis, the conical wall tapering inwardly and towards an outlet opposite the base;

an inlet opening into the chamber and tangent to the conical wall so as to cause injected fluid to rotate within the chamber; and a hydraulic dam mounted to the conical wall beneath the inlet and between the inlet and the outlet, the hydraulic dam extending from the wall towards the axis; and further comprising a second chamber connected to the outlet of the conical chamber, the second chamber having an outlet for accepts flow, and a vortex finder extending into the outlet of the conical chamber, the vortex finder having an outlet for flow containing light weight reject particles.

15. A cleaner for separating heavyweight reject particles and light reject particles from acceptable particles in an input fluid flow, the cleaner of the type having a body having a fluid inlet through which the input fluid flow is injected into the cleaner; portions of the body defining a first chamber having outer inverted conical walls, wherein the input fluid is injected tangentially into the chamber, and wherein the input fluid is caused to be distributed within the inverted conical chamber such that the heavyweight reject particles are positioned in closer proximity to the walls, the lightweight reject particles are positioned centrally along the axis of the chamber and the acceptable particles are positioned primarily between the heavyweight reject particles and the lightweight reject particles; a tube which extends axially within the body to receive a portion of the flow containing lightweight reject particles; portions of the body defining a second chamber having generally frustoconical walls, the diameter of the second chamber narrowing as it extends upwardly, wherein the second chamber is positioned beneath the first chamber; portions of the body defining a heavyweight reject outlet which extends outwardly from the walls of the second chamber; portions of the body defining an acceptable particle flow outlet positioned below the second chamber and in communication therewith; and a first splitter fixed to the body to extend into the second chamber above the acceptable particle flow outlet, wherein the splitter has a lip which extends into the flow from the first chamber, said lip serving to split a portion of said flow containing heavyweight reject particles into the second chamber, while allowing the remainder of the flow containing acceptable particles to flow to the acceptable particle flow outlet, and wherein a recirculating flow is established within the second chamber of a portion of the flow containing heavyweight reject particles, said recirculating flow extending adjacent the flow downward from the first chamber with low turbulence, the improvement comprising:

a hydraulic dam mounted to the first chamber inverted conical walls, the hydraulic dam being positioned below the fluid inlet to create a symmetric rotating flow through the first chamber.

16. The cleaner of claim 15 wherein the hydraulic dam is a smooth ring projecting inwardly from the first chamber outer inverted conical walls.

17. A cleaner for separating heavyweight reject particles and light reject particles from acceptable particles in an input fluid flow, the cleaner of the type having a body having a fluid inlet through which the input fluid flow is injected into the cleaner, a heavyweight particle flow outlet, a lightweight particle flow outlet, and an acceptable particle flow outlet; portions of the body which define a first chamber having outer inverted conical walls, said first chamber narrowing as it extends downwardly, and wherein the input fluid flow is caused to be distributed within the inverted conical chamber such that the heavyweight reject particles are positioned in closer proximity to the walls, the lightweight reject particles are positioned centrally along the axis of the chamber and the acceptable particles are positioned primarily between the heavyweight reject particles and the lightweight reject particles; a tube which extends axially within the body to receive a portion of the flow containing lightweight reject particles, said tube being in communication with the lightweight particle flow outlet; portions of the body defining a second chamber beneath the first chamber, wherein the second chamber has frustoconical walls, the diameter of the frustoconical chamber increasing as it extends downwardly; means for splitting a flow of fluid containing acceptable particles and heavyweight reject particles into separate flows containing either primarily acceptable particles or heavyweight reject particles, said splitting means being positioned adjacent said second chamber; means for directing at least a portion of said spit flow containing heavyweight reject particles into recirculation within the second chamber, said directing means causing the split heavyweight reject flow portion to have rotational and axial flow rates substantial matched to the rotational and axial flow rates of adjacent unsplit heavyweight reject flows approaching the means for splitting, thereby reducing turbulence therebetween, wherein the improvement comprises:

a means for creating a symmetric rotating flow in the first chamber.

* * * * *